US006038949A

United States Patent [19]

Jander

[11] Patent Number: 6,038,949

[45] Date of Patent: Mar. 21, 2000

[54] METHOD FOR DISPENSING REINFORCEMENT FIBERS

[75] Inventor: Michael Horst Jander, Eupen, Belgium

[73] Assignee: NV Owens-Corning S.A., Brussels, Belgium

[21] Appl. No.: 09/152,980

[22] Filed: Sep. 14, 1998

[51] Int. Cl.[7] ..... B26D 1/00

[52] U.S. Cl. ..... 83/13; 83/28; 156/174

[58] Field of Search ..... 83/13, 23, 28, 83/155, 155.1, 907, 913; 156/167, 169, 174; 29/417; 242/361.2, 361.3

[56] References Cited

U.S. PATENT DOCUMENTS

| | | | |
|---|---|---|---|
| 2,954,817 | 10/1960 | Havemann | 156/382 |
| 3,170,197 | 2/1965 | Brenner | 156/167 |
| 3,719,540 | 3/1973 | Hall | 156/167 |
| 3,728,189 | 4/1973 | Hames . | |
| 3,831,879 | 8/1974 | Miller et al. | 156/169 |
| 3,892,307 | 7/1975 | Scholl | 198/195 |
| 3,977,069 | 8/1976 | Domaingue, Jr. | 29/417 |
| 4,001,935 | 1/1977 | Krohn et al. . | |
| 4,169,397 | 10/1979 | Vehling et al. | 83/913 |
| 4,178,670 | 12/1979 | Schmid | 29/417 |
| 4,352,769 | 10/1982 | Meyer . | |
| 4,417,937 | 11/1983 | Escher et al. | 156/169 |
| 4,519,281 | 5/1985 | Spaller | 83/913 |
| 4,630,515 | 12/1986 | Spaller | 83/913 |
| 4,750,960 | 6/1988 | Bubeck | 156/169 |
| 4,854,990 | 8/1989 | David | 156/173 |
| 4,944,446 | 7/1990 | Thompson | 29/417 |
| 4,973,440 | 11/1990 | Tamura et al. | 264/114 |
| 5,020,403 | 6/1991 | D'Angelo et al. | 29/417 |
| 5,078,934 | 1/1992 | Yamamoto et al. | 265/102 |
| 5,084,305 | 1/1992 | Marttila | 427/389.8 |
| 5,158,631 | 10/1992 | Leoni et al. | 156/174 |
| 5,192,390 | 3/1993 | Perkins | 156/174 |
| 5,202,071 | 4/1993 | Nakamura et al. | 264/137 |
| 5,204,033 | 4/1993 | Pearce et al. | 156/174 |
| 5,229,052 | 7/1993 | Billiu | 264/115 |
| 5,262,106 | 11/1993 | Graham et al. | 264/108 |
| 5,463,919 | 11/1995 | Paybarah et al. | 83/907 |
| 5,484,641 | 1/1996 | Rotter | 264/128 |
| 5,806,387 | 9/1998 | Jander | 83/13 |

FOREIGN PATENT DOCUMENTS

| | | |
|---|---|---|
| 2030408 | 11/1970 | France . |
| 1265123 | 3/1972 | France . |
| 1694724 | 8/1989 | U.S.S.R. . |
| 2158471 | 11/1985 | United Kingdom . |
| WO 95/01939 | 1/1995 | WIPO . |
| WO 96/32239 | 10/1996 | WIPO . |

OTHER PUBLICATIONS

Mats Ericson—"Processing, structure and properties of glass mat reinforced thermoplastics", Linkoping 1992.

Michael Jander—"Industrial RTM: New developments in molding and preforming technologies".

*Primary Examiner*—M. Rachuba

*Attorney, Agent, or Firm*—Inger H. Eckert

[57] ABSTRACT

A method for dispensing discrete length reinforcement fibers. A continuous length of a reinforcement fiber is wound around a base end of a form, the base end having a generally circular cross-section, to form generally circular coils. The coils are moved axially from the base end of the form to an elongated portion of the form, the elongated portion having an elongated cross-section, to change the shape of the coils from the generally circular shape to an elongated shape. The elongated coils are cut to form discrete length reinforcement fibers. The discrete length reinforcement fibers are then dispensed.

20 Claims, 7 Drawing Sheets

METHOD FOR DISPENSING REINFORCEMENT FIBERS

CROSS-REFERENCE TO RELATED APPLICATIONS

This application is related to U.S. application Ser. No. 08/660,381, filed Jun. 7, 1996, which will issue as U.S. Pat. No. 5,806,387 on Sep. 15, 1998, and which is a continuation-in-part of U.S. application Ser. No. 08/419,621, filed Apr. 10, 1995, both naming Michael H. Jander as the inventor.

TECHNICAL FIELD AND INDUSTRIAL APPLICABILITY OF THE INVENTION

This invention relates to a method for dispensing reinforcement fibers, and particularly it relates to a method for dispensing discrete length reinforcement fibers to form a reinforcement mat, a reinforcement preform, or other type of reinforcement structure

BACKGROUND OF THE INVENTION

The process of cutting continuous reinforcement fibers into discrete length reinforcement fibers is useful in the manufacture of different types of reinforcement structures. For example, the discrete length reinforcement fibers can be used in reinforcement mats such as mats made with commingled fibers (e.g., carbon fibers commingled with thermoplastic fibers), or laminated mats made from layers of fibers.

The discrete length reinforcement fibers can also be used in reinforcement preforms. Structural composites and other reinforced molded articles are commonly made by resin transfer molding and structural resin injection molding. These molding processes have been made more efficient by preforming the reinforcement fibers into a reinforcement preform which is the approximate shape and size of the molded article, and then inserting the reinforcement preform into the mold. To be acceptable for production at an industrial level, a fast preforming process is required. In the manufacture of preforms, a common practice is to supply a continuous length of reinforcement strand or fiber to a reinforcement dispenser (or "chopper"), which cuts the continuous fiber into many discrete length fibers, and deposits the discrete length fibers onto a collection surface. This process can be used to make preforms in an automated manner by mounting the reinforcement dispenser for movement over the collection surface, and programming the movement of the dispenser to apply the reinforcement fibers in a predetermined, desired pattern. The reinforcement dispenser can be robotized or automated, and such reinforcement dispensers are known art for such uses as making preforms for large structural parts, as in the auto industry, for example. (Dispensers of reinforcement fibers for the manufacture of mats of commingled fibers or laminated mats can also be adapted to be moveable and programmable.) Typically, the deposited fibers are dusted with a powdered binder, and compressed with a second perforated mold. Hot air and pressure sets the binder, producing a preform of reinforcement fibers which can be stored and shipped to the ultimate molding customer which applies resin to the preform and molds the resinated preform to make a reinforced product, typically using a resin injection process.

As the technical requirements for reinforcement structures increase, new methods for dispensing and laying down reinforcement fibers are required. One requirement is that the reinforcement fibers be delivered at faster speeds than used previously. Another requirement is that the reinforcement fibers be laid down in a predetermined orientation. The advancement in the reinforcement technology enabling a moveable and programmable reinforcement dispenser has led to requirements for very sophisticated fiber patterns and orientations. Reinforcement structures can be designed with specific amounts and of reinforcement fibers to improve the strength of the structure precisely at the weakest or most stressed location of the article to be reinforced. Because of this new sophistication, there often is a requirement that the fibers be laid onto the collecting surface in a closely spaced, parallel arrangement.

Previous efforts to deliver closely spaced, parallel fibers have not been successful, especially at the high speeds necessary for commercial operations. When typical reinforcement dispensers are operated at a faster speed, the resulting discrete length reinforcement fibers cannot be successfully laid down in a parallel, closely spaced orientation. The fibers are directed toward the collecting surface in a direction generally perpendicular to the collection surface, and this procedure does not tend to leave the fibers parallel and closely spaced. Further, typical nozzle-type reinforcement dispensers use an air flow to guide the reinforcement fiber into engagement with the cutting blade, and to dispense the is discrete length fibers after cutting, thereby introducing turbulence to the collection surface which disturbs the orientation of the fibers.

Previous patents also describe methods for dispensing reinforcement fibers which are not successful in dispensing the fibers in a parallel orientation at high speeds. For example, both U.S. Pat. No. 4,169,397 to Vehling and Russian Pat. No. 1,694,724 to Zhitomirskii disclose winding a continuous length of a reinforcement fiber around a circular form to make circular coils, and then cutting the circular coils into discrete length reinforcement fibers. The resulting fibers are dispensed in a random orientation instead of a parallel orientation.

In contrast to the previous efforts, co-pending U.S. application Ser. No. 08/419,621, filed Apr. 10, 1995, discloses a method for dispensing reinforcement fibers which successfully dispenses the fibers in a parallel orientation at high speeds. In the disclosed method, a continuous length of a reinforcement fiber is wound into elongated coils around a form, and then the elongated coils are cut into discrete length reinforcement fibers. The resulting fibers are dispensed in a parallel orientation.

However, there is still a need for an improved method for dispensing reinforcement fibers in a parallel orientation which allows the fibers to be dispensed even more rapidly, so that production on an industrial level can be even more efficient. There is also a need for an improved method for dispensing reinforcement fibers which is gentler on the fibers, so that different types of fibers can be used which are too brittle or too weak to dispense without breaking by previous methods.

SUMMARY OF THE INVENTION

The above objects as well as other objects not specifically enumerated are achieved by a method for dispensing discrete length reinforcement fibers including the steps of: (a) winding a continuous length of a reinforcement fiber around a base end of a form, the base end having a generally circular cross-section, to form generally circular coils; (b) moving the coils axially from the base end of the form to an elongated portion of the form, the elongated portion having an elongated cross-section, the coils being moved on a generally smooth exterior surface of the form which changes gradually from the generally circular cross-section to the elongated cross-section, to gradually change the shape of the coils from the generally circular shape to the elongated shape; (c) cutting the elongated coils to form discrete length reinforcement fibers; and (d) dispensing the discrete length reinforcement fibers.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 1:
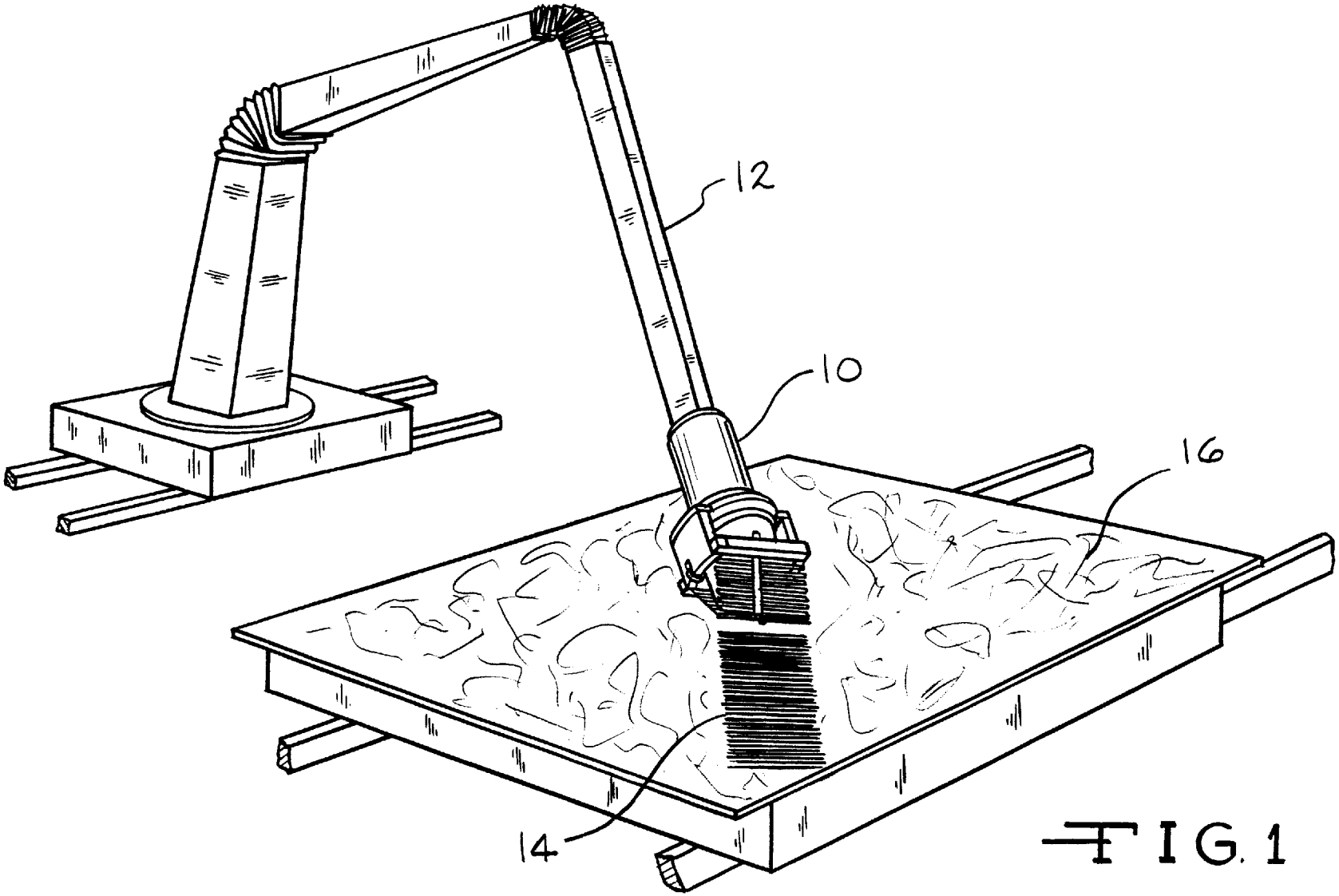
FIG. 1 is a perspective view illustrating a reinforcement dispenser attached to a robot arm, the reinforcement dispenser depositing discrete length reinforcement fibers onto a collection surface according to the method of the invention.

As shown in FIG. 1, a reinforcement dispenser 10 attached to a robot arm 12 is positioned to deposit discrete length reinforcement fibers 14 onto a collection surface 16, such as preform molding surface. Typically the collection surface is a screen. The reinforcement dispenser need not be robotized or automated, and could even be stationary with the collection surface being moveable. A source of vacuum (not shown) is usually positioned beneath the screen to facilitate the preform making process. The robot arm can be provided with a hydraulic system (not shown) or other similar system to enable the arm to be positioned adjacent or above any portion of the collection surface. The movement of the arm can be controlled by a computer (not shown) according to a predetermined pattern so that a desired pattern of reinforcement fibers is laid down on the collection surface.

Figure 2:
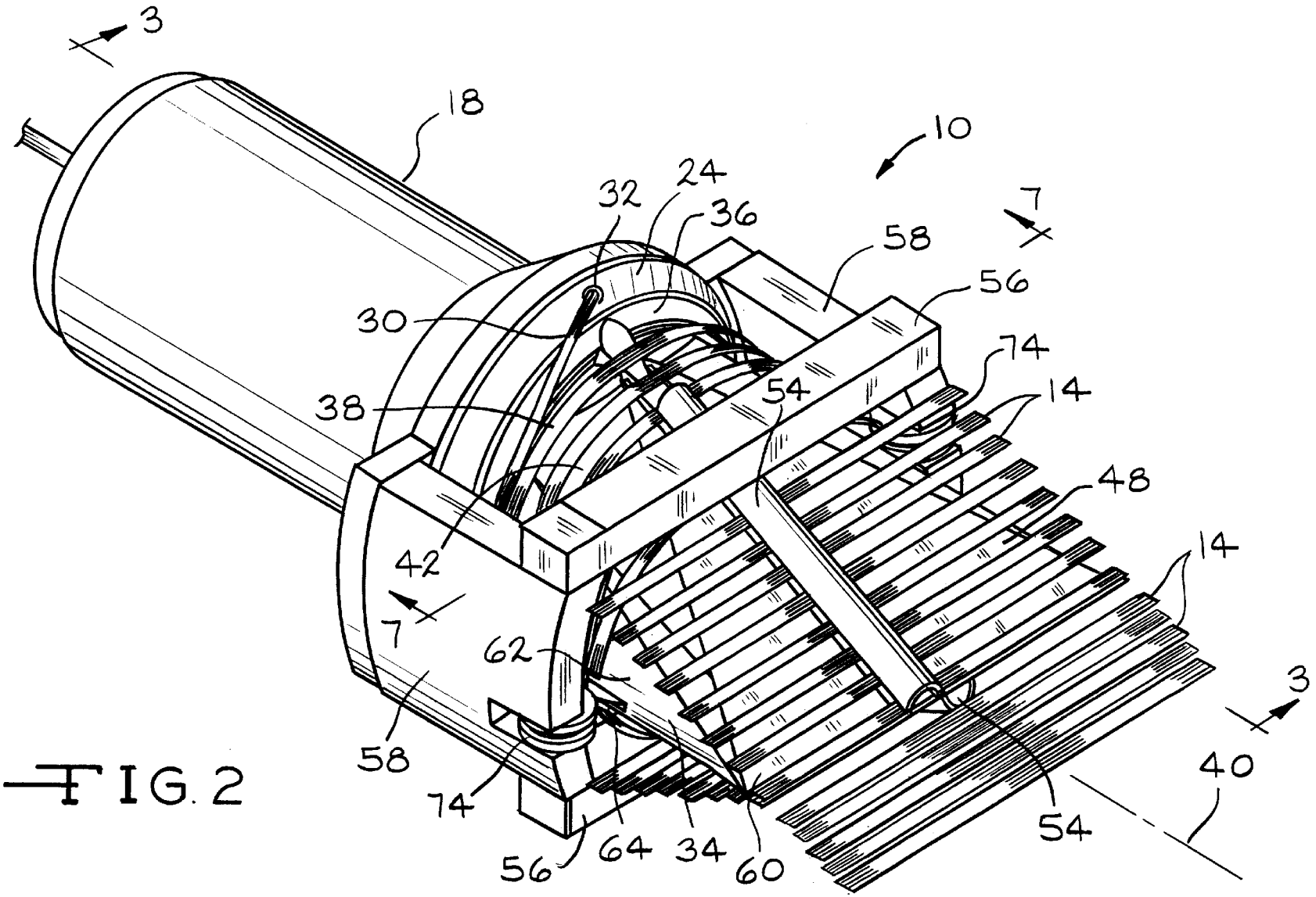
FIG. 2 is a perspective view of the reinforcement dispenser of FIG. 1.
Figure 3:
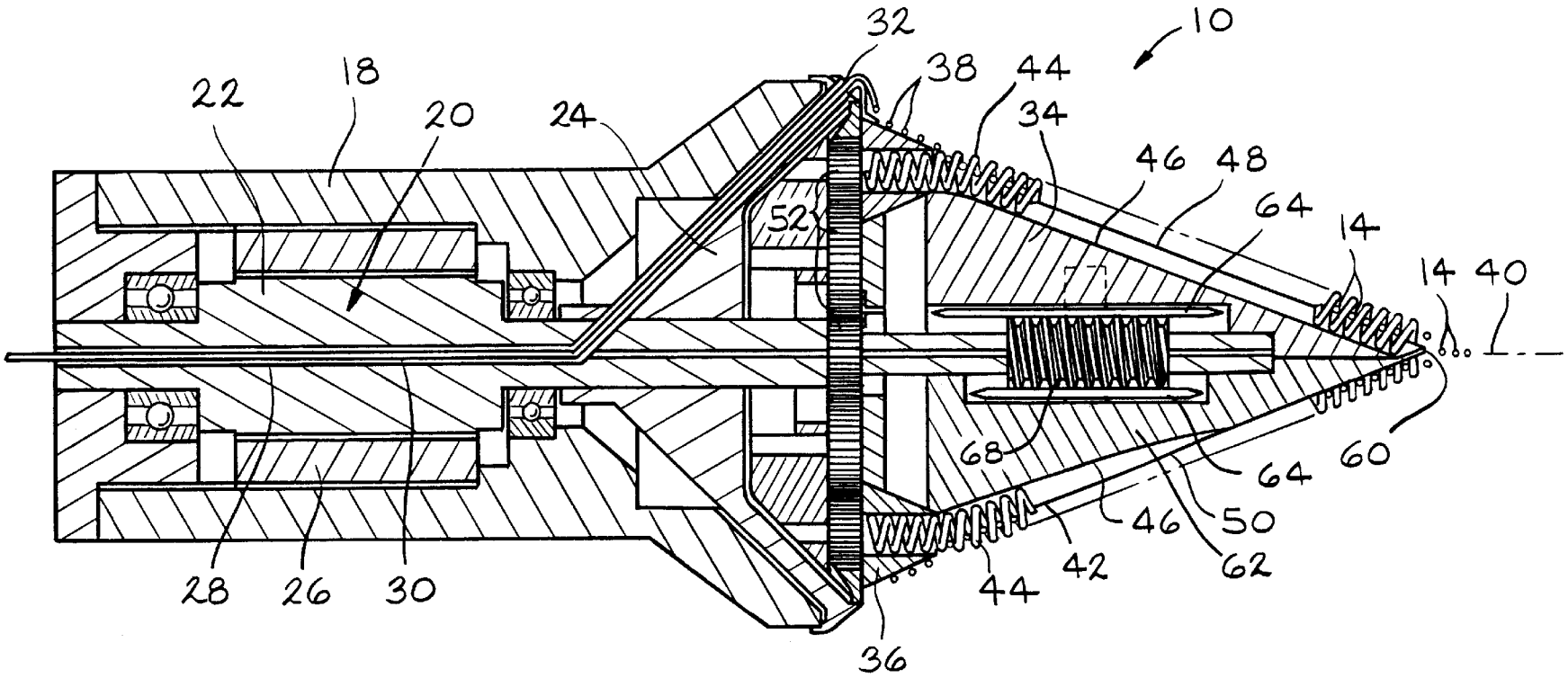
FIG. 3 is a cross-sectional view of the reinforcement dispenser taken along line 3—3 of FIG. 2.

Referring now to FIGS. 2 and 3, the structure and operation of the reinforcement dispenser 10 is illustrated in more detail. The reinforcement dispenser includes a generally cylindrical outer housing 18. A rotating member such as a rotor 20 is mounted for rotation within the housing. The rotor includes a generally cylindrical input end 22 and a generally conical output end 24. The rotor is rotated by any suitable means, such as a motor 26 surrounding the input end of the rotor. A feed passage 28 extends longitudinally through the center of the input end of the rotor, and then along the outer surface of the output end of the rotor. A continuous reinforcement fiber 30 or strand, such as a roving, is supplied from a source not shown, and is transported to the reinforcement dispenser through the robot arm. The continuous reinforcement fiber is fed through the feed passage inside the rotor, and then exits through an output hole 32 at the downstream end of the rotor.

Figure 4:
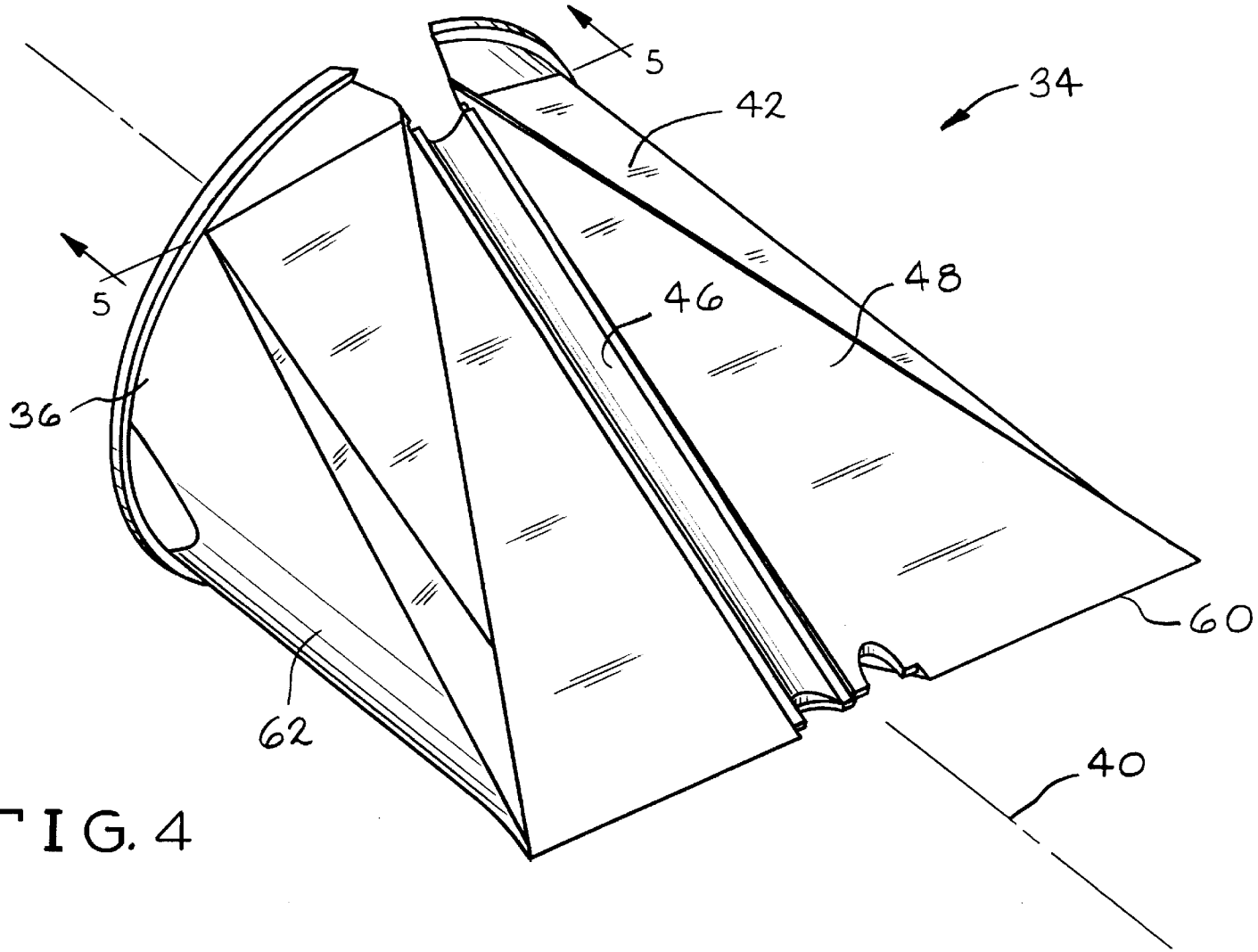
FIG. 4 is a perspective view of a form of the reinforcement dispenser of FIG. 1.
Figure 6:
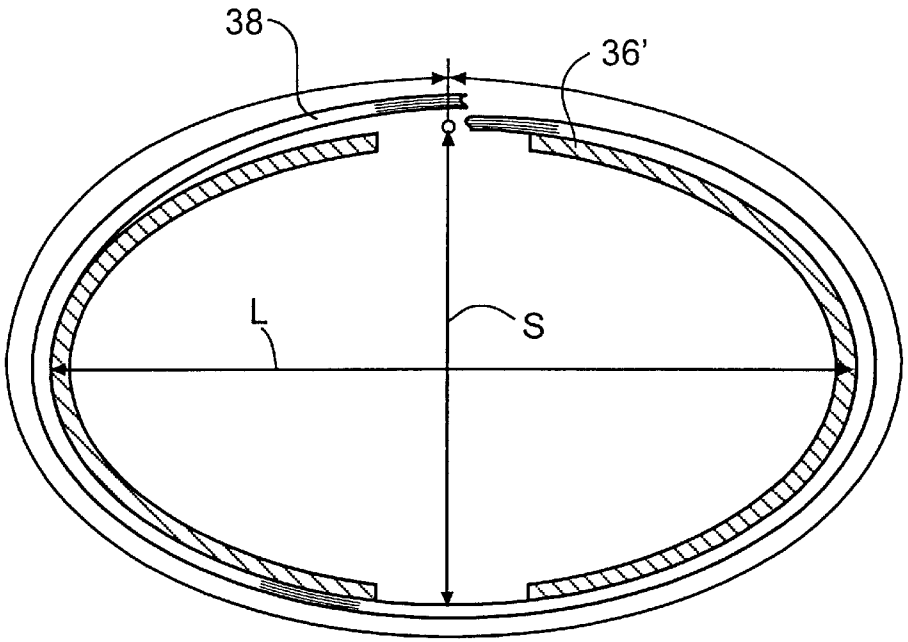
FIG. 6 is a cross-sectional view of the outer surface of a base end of an alternate embodiment of the form.
Figure 5:
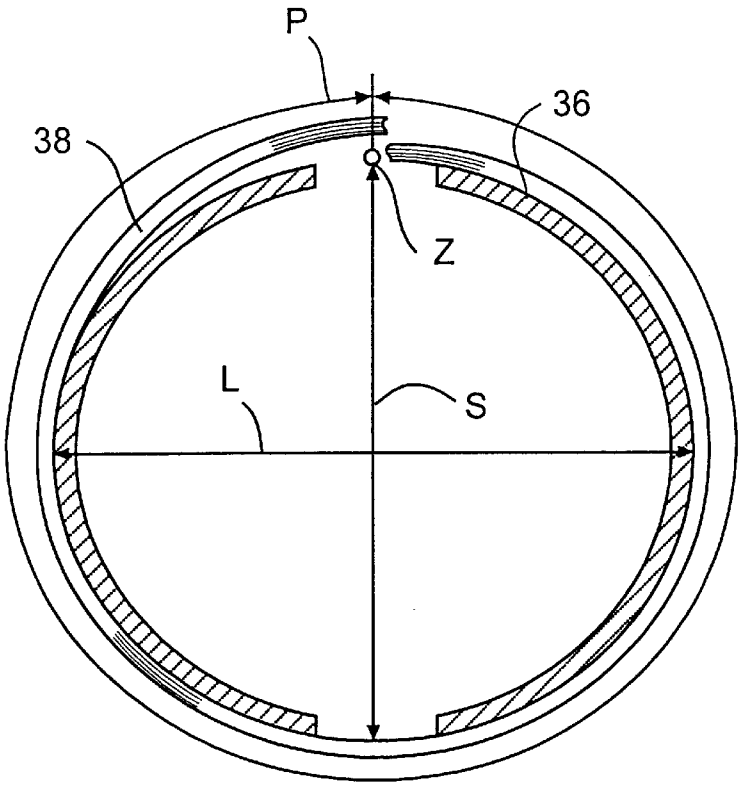
FIG. 5 is a cross-sectional view of the outer surface of a base end of the form taken along line 5—5 of FIG. 4, showing a coil of fiber wrapped around the form. (For purposes of simplification, the outer surface is shown as a shell in this figure.)

Positioned downstream from the rotor is a form 34 around which the continuous reinforcement fiber 30 is wound by the rotating action of the rotor 20. As best shown in FIGS. 4 and 5, the form 34 includes a base end 36 having a generally circular cross-section. The continuous reinforcement fiber is wound around the generally circular base end of the form, to form generally circular loops or coils 38. The term "generally circular" means that the ratio of the longest diameter, L, to the shortest diameter, S, is less than 2:1. For example, a perfect circle has an L:S ratio of 1:1. In the illustrated embodiment, the base end 36 of the form his an L:S ratio of about 1.1:1, and the coil wrapped around the base end has substantially the same L:S ratio. FIG. 6 illustrates an alternate embodiment in which the base end 36' of the form is somewhat oblong but is still generally circular, because the base end has an L:S ratio of about 1.6:1, which is less than 2:1. Preferably, the base end of the form has an L:S ratio of not greater than about 1.8:1, more preferably not greater than about 1.5:1, more preferably not greater than about 1.3:1, and optimally about 1:1.

Preferably, the base end of the form has a minimum radius (one-half the shortest diameter, S) of at least about 15 millimeters to ensure gentle winding of the continuous reinforcement fiber around the base end of the form.

The generally circular winding method is gentler on the continuous reinforcement fiber than the winding method described in co-pending U.S. application Ser. No. 08/419,621. In that method, the continuous reinforcement fiber is wound around two parallel rods to form elongated coils. There is an inherent speed or pull variation when winding the continuous reinforcement fiber around two rods, resulting in a variation in tension on the fiber. There is also a bending stress on the continuous reinforcement fiber in winding the fiber around a rod having a relatively small diameter. The generally circular winding is gentler because it avoids the variation in tension and the bending stress on the continuous reinforcement fiber.

The gentler winding around the generally circular form allows increased speeds in winding the continuous reinforcement fiber around the form without breaking the fiber, thereby allowing higher output and more efficient production. In a preferred embodiment, the winding around the generally circular form allows an increase in winding speed of at least about 10% compared with the maximum winding speed around an elongated form having the same peripheral length, and more preferably it allows an increase in winding speed of at least about 20%.

The gentler winding also allows the use of continuous reinforcement fibers which would otherwise be too brittle or too weak to be wound without breaking. For example, carbon fibers such as graphite fibers are desirable for use as reinforcement fibers because they are lightweight and high strength. However, carbon fibers are relatively brittle and susceptible to breakage. The generally circular winding allows the carbon fibers to be wound without substantial breakage. In one embodiment of the invention, the generally circular winding allows the use of carbon fibers having an elongation at break within a range of between about 0.9% and about 1.5%.

Of course, the invention is not limited to the use of weaker or more brittle continuous reinforcement fibers. In general, the continuous reinforcement fiber can be any fibrous material suitable for reinforcement purposes. One suitable material is assembled glass fiber roving, available from Owens Corning, Toledo, Ohio, although other mineral fibers and organic fibers, such as polyester and Kevlar®, can be used with the invention. It is to be understood that the continuous fiber can be a single filament (monofilament) or a strand comprised of numerous filaments. Typically, a glass fiber roving consists of anywhere from about 2200 to about 4800 tex, where a tex is defined as one gram per 1000 meters of filament. The roving is usually formed by combining a plurality of strands, with each strand being about 25 to about 100 tex. The gentler winding around the generally circular form reduces the breakage rate with any type of fiber compared to winding around an elongated form.

As shown in FIGS. 2–4, the form 34 has a longitudinal axis 40, which may be colinear with the axis of revolution of the rotor. Once the coils 38 of continuous reinforcement fiber are positioned around the base end 36 of the form, the coils are moved axially downstream along the exterior surface 42 of the form (to the lower right in FIG. 2, and to the right in FIG. 3). (For purposes of illustration, the coils 38 in FIG. 2 are shown having an exaggerated thickness.) Any means can be used to move the coils axially with respect to the form. In the illustrated embodiment, the coils are moved downstream by the action of a pair of helical springs 44 (not shown in FIG. 2). The springs are mounted for rotation in grooves 46 on upper and lower surfaces 48, 50 of the form. The springs 44 are operatively connected to the rotor 20 through a series of gears 52, such that rotation of the rotor causes rotation of the springs. The rotation of the springs causes the surface of each spring to engage the coils and to urge the coils axially downstream with respect to the form. The coils are closely spaced and generally parallel to each other as they are moved along the form. A pair of guides 54 are mounted over the springs. The guides are mounted on a pair of cross pieces 56 which extend between a pair of side pieces 58 on opposing sides of the form. (For purposes of simplification, the guides and cross pieces are riot shown in FIG. 3.) Other suitable means to move the coils axially with respect to the form include conveyors or belts, or a vibrational system which vibrates the form and uses gravity to cause the coils to move downstream.

As shown in FIG. 4, the form 34 is generally cylindrical at the base end 36, but it changes its shape in the axial direction, gradually tapering to become progressively flatter and wider. Opposite the base end, the form has a discharge end 60 which comprises an elongated, linear edge. As described below, the discrete length reinforcement fibers are dispensed from the discharge end of the form.

Figure 7:
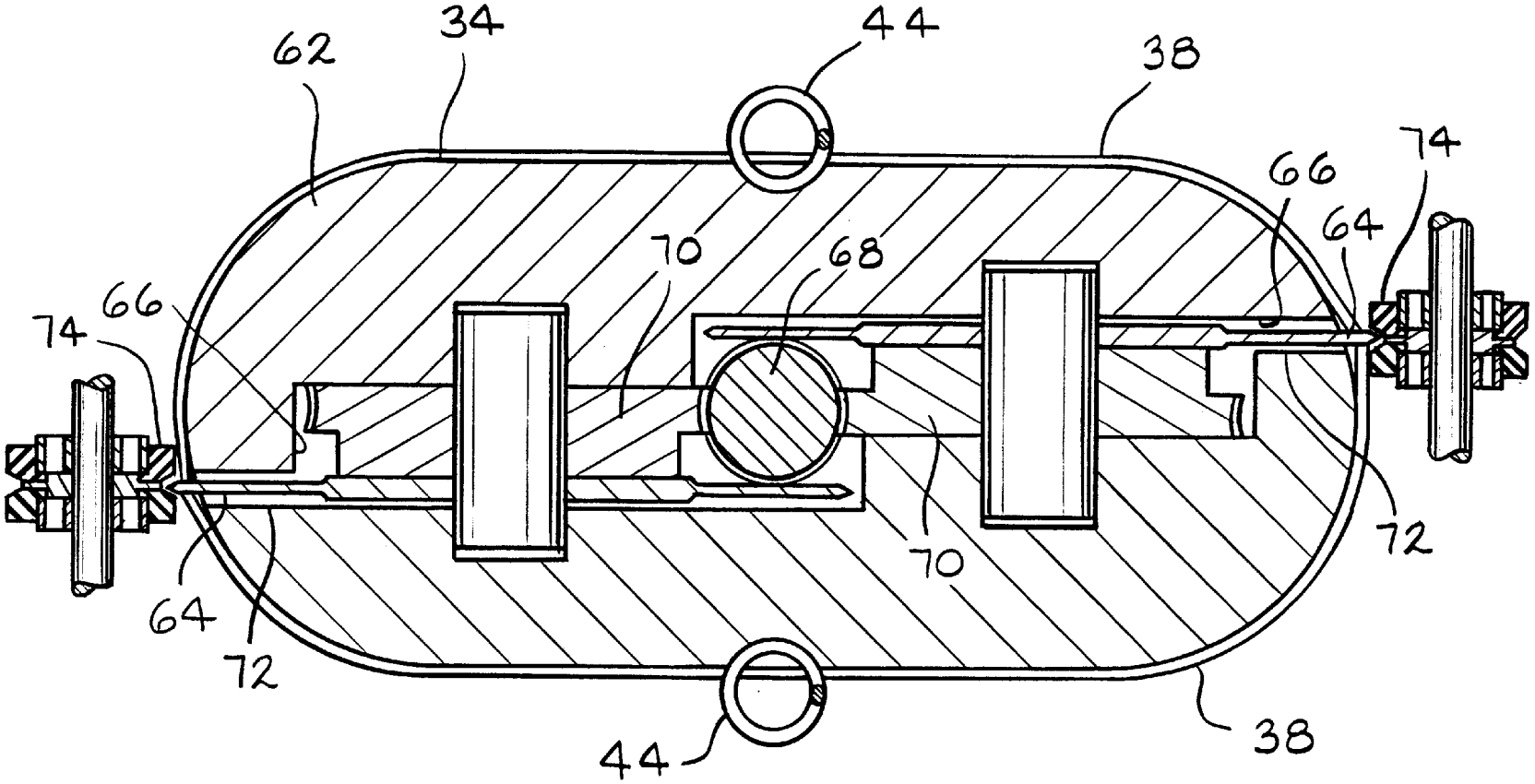
FIG. 7 is a cross-sectional view of the reinforcement dispenser taken along line 7—7 OF FIG. 2, including an elongated portion of the form.
Figure 8:
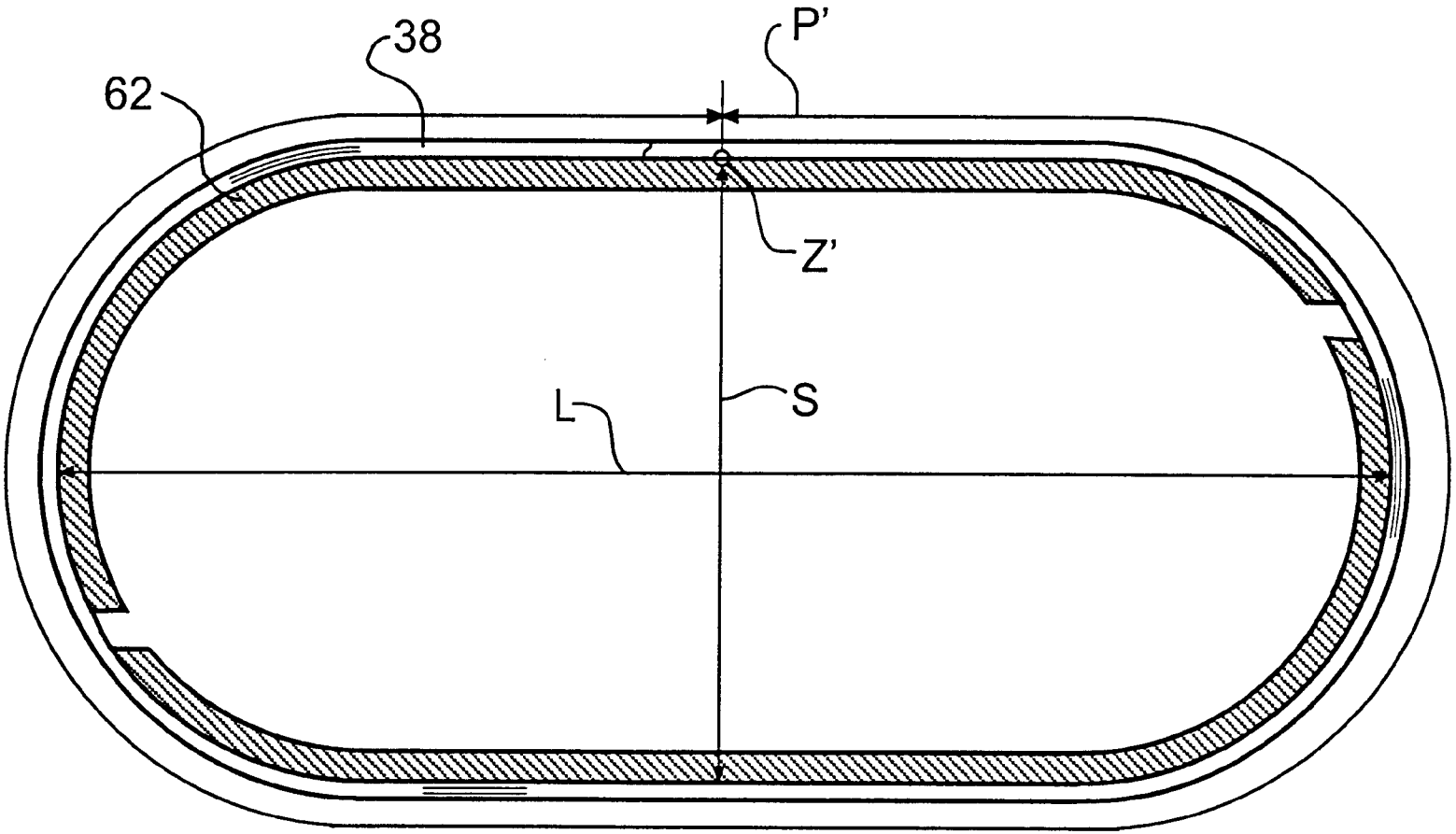
FIG. 8 is a cross-sectional view of the outer surface of the elongated portion of the form of FIG. 7, showing a coil of fiber wrapped around the form. (For purposes of simplification, the outer surface is shown as a shell in this figure.)

The form 34 includes an elongated portion 62 between the base end 36 and the discharge end 60. In the illustrated embodiment, the elongated portion is located approximately one-half the distance between the base end and the discharge end. The coils 38 are moved axially downstream from the base end to the elongated portion. As best shown in FIGS. 7 and 8, the elongated portion 62 of the form his an elongated cross-section. The term "elongated" means that the ratio of the longest diameter, L, to the shortest diameter, S, is at least 2:1. In the illustrated embodiment, the elongated portion of the form has an L:S ratio of about 2.15:1.

The coils are moved axially downstream on the exterior surface 42 of the form 34 between the base end 36 and the elongated portion 62. The exterior surface of the form is generally smooth and it changes gradually from the generally circular cross-section to the elongated cross-section, so that the shape of the coils changes gradually from the generally circular shape to the elongated shape. As shown in FIG. 8, the elongated coils 38 have substantially the same L:S ratio as the elongated portion 62 of the form around which the coils are wound. The changing shape of the form allows the coils to be wound gently around the generally circular base end of the form, and then allows the coils to change shape to a desirable elongated shape prior to the cutting step (described below). The elongated cross-section of the coils allows the coils to be cut into discrete lengths which are moved and dispensed parallel to each other. This contrasts with the previous patents which do not suggest initially winding generally circular coils, and then modifying the coils to an elongated shape prior to the cutting step. The methods disclosed in the previous patents dispense random fibers instead of parallel fibers.

Between the base end 36 and the elongated portion 62, the form 34 has a generally constant peripheral length (the distance around the perimeter of the form). In FIG. 5, the peripheral length P of the form at the generally circular base end 36 is the distance from point Z around the perimeter of the form back to point Z. In FIG. 8, the peripheral length P' of the form at the elongated portion 62 is the distance from point Z' around the perimeter of the form back to point Z'. As the form becomes flatter and wider between the base end 36 and the elongated portion 62, the peripheral length P' at the elongated portion remains substantially the same as the peripheral length P at the base end. The generally constant peripheral length of the form is important for the movement of the coils on the form, and for the cutting of the coils into discrete length fibers. If the peripheral length of the form was decreased between the base end and the elongated portion, the coils would sag on the form as they moved downstream, and it would be difficult to move the coils, and to maintain the coils in a closely spaced, parallel relationship. The coils should be slightly stretched when they are moved downstream. Also, the coils should be slightly stretched when they engage the cutter (described below), for proper cutting of the coils into the discrete length fibers. If the peripheral length of the form was increased between the base end and the elongated portion, the coils would tighten too much around the form as they moved downstream, and the movement of the coils would be impaired. In addition to having a generally constant peripheral length between the base end and the elongated portion, the form preferably has a generally constant peripheral length between the elongated portion and the discharge end.

The elongated coils 38 are moved axially with respect to the form 34, to engage a cutter. In the embodiment shown in FIGS. 2, 3 and 7, the cutter comprises a pair of rotary knives 64. The cutter makes one or more cuts in each elongated coil to form discrete length reinforcement fibers 14. A typical length of reinforcement fiber is within the range of from about 15 to about 100 mm. The cutter can be of any type capable of severing the elongated coils into discrete lengths of fibers. Examples of cutters include heating devices and lasers. In the illustrated embodiment, the knives 64 which are rotatably mounted inside cavities 66 in the form 34, on opposing sides of the form. A worm gear 68 rotatably driven by the rotor 20 engages corresponding gears 70 connected to the rotary knives to cause rotation of the knives. The knives extend laterally through slots 72 in the exterior surface of the form on opposing sides of the form. Positioned adjacent the knives, outside the form, are backup rolls or cot rolls 74 which act to press each coil 38 sharply into the knives 64 to insure cutting rather than merely dragging the coil across the knives. Cot rolls used with cutters are well known, and can be of any suitable material. The illustrated cot rolls are mounted for rotation in the side pieces of the reinforcement dispenser.

The method of cutting the coils using two knives 64, as shown in FIGS. 2, 3 and 7, results in two discrete fibers 14 from each of the coils 38. Alternatively, only one knife could be used to produce only one discrete fiber from each coil (not shown). In such a case, it may be advantageous for the reinforcement dispenser to be equipped with fiber handling apparatus, such as modified guide plates (not shown), to be adapted to open up the discrete length fibers after cutting, and align them in a generally parallel orientation.

Preferably, the continuous reinforcement fiber 10 is wound at least five times around the form 34 (i.e., wound into at least five coils 38) before engaging the cutter. Winding at least five coils before cutting the continuous reinforcement fiber prevents slippage of the fiber.

As shown in FIGS. 1–3, after the elongated coils 38 are cut by the knives to form the discrete length reinforcement fibers 14, the fibers are moved axially downstream by the springs 44. The fibers 14 are moved in two streams on the upper and lower surfaces 48, 50 of the form 34. The upper and lower surfaces are smooth and flattened to facilitate the movement of the fibers to the discharge end 60 of the form. The guides 54 hold the fibers adjacent to the upper and lower surfaces of the form as they are moved downstream. Because the form tapers to an edge at the discharge end, the two streams of fibers converge at the discharge end and combine into a single stream of closely spaced, generally parallel fibers. The upper and lower surfaces 48, 50 of the form become wider in the direction of the discharge end 60, so that at the discharge end the upper and lower surfaces are approximately as wide as the length of the fibers 14. This shape helps to hold the fibers straight and parallel as they approach the discharge end. The fibers are dispensed from the discharge end of the form. The discrete lengths of fibers are laid down in a generally parallel, closely spaced fashion on the collection surface 16. Preferably, the discrete length fibers are dispensed in an axial direction with respect to the form, but baffles or air jets could be used to dispense the discrete length fibers in other directions. Since the discrete length fibers are formed by cutting the coils 38, they are oriented generally perpendicular to the longitudinal axis 40 of the form as they are dispensed, and are generally parallel to the collection surface.

Optionally, the discrete length reinforcement fibers can be resinated before they are dispensed, by any suitable means. The resin can be a thermoset resin, such as a polyester, epoxy, phenolic or polyurethane resin. The resin can also be a thermoplastic such as Nyrim® resin or others.

It should be understood that, although the invention is illustrated as a method for dispensing discrete length reinforcement fibers for use in a preform, the invention is also useful in the manufacture of other reinforcement structures, such as mats made with commingled fibers or laminated mats. Although the reinforcement dispenser shown in the drawings includes a stationary form around which a continuous reinforcement fiber is wound by the rotating action of a rotor, in an alternative design (not shown) the form could be rotated and the rotor could be stationary. This arrangement would provide the same result of winding the continuous reinforcement fiber into coils around the form. Also, both the form and the rotor could be mounted for rotation, and rotated at different rates to wind the continuous reinforcement fiber into coils around the form.

The principle and mode of operation of this invention have been described in its preferred embodiments. However, it should be noted that this invention may be practiced otherwise than as specifically illustrated and described without departing from its scope.

What is claimed is:

1. A method for dispensing discrete length reinforcement fibers comprising the steps of:

winding a continuous length of a reinforcement fiber around a base end of a form, the base end having a generally circular cross-section, to form generally circular coils, the form having a longitudinal axis;

moving the coils axially from the base end of the form to an elongated portion of the form, the elongated portion having an elongated cross-section, the coils being moved on a generally smooth exterior surface of the form which changes gradually from the generally circular cross-section to the elongated cross-section, to gradually change the shape of the coils from the generally circular shape to the elongated shape;

cutting the elongated coils to form discrete length reinforcement fibers; and dispensing the discrete length reinforcement fibers.

2. The method of claim 1 in which the step of moving the coils from the base end of the form to the elongated portion of the form includes moving the coils on the form, with the form having a generally constant peripheral length between the base end and the elongated portion.

3. The method of claim 1 in which the reinforcement fiber is wound without breaking around the base end having the generally circular cross-section, at a winding speed which is at least about 10% greater than a maximum winding speed around a form having an elongated cross-section with the same peripheral length as the base end.

4. The method of claim 1 in which the step of winding the reinforcement fiber comprises winding the reinforcement fiber around a base end having a minimum radius of at least about 15 millimeters.

5. The method of claim 1 in which the step of winding the reinforcement fiber comprises winding a carbon fiber having an elongation at break within a range of between about 0.9% and about 1.5%.

6. The method of claim 1 in which the discrete length reinforcement fibers are dispensed generally parallel to each other.

7. The method of claim 1 in which the step of winding the reinforcement fiber comprises winding the reinforcement fiber around a base end having a cross-section with a ratio of a longest diameter to a shortest diameter of not greater than about 1.8:1.

8. The method of claim 1 in which the step of moving the coils to the elongated portion of the form comprises moving the coils to an elongated central portion of the form, and in which the step of dispensing the discrete length reinforcement fibers comprises dispensing the reinforcement fibers from a discharge end of the form which is opposite the base end of the form.

9. The method of claim 1 in which the step of dispensing the discrete length reinforcement fibers comprises moving the discrete length reinforcement fibers axially from the cutter to a discharge end of the form, on a smooth exterior surface of the form, the discharge end comprising an elongated edge, and dispensing the discrete length reinforcement fibers from the discharge end.

10. The method of claim 1 in which the step of moving the coils axially is accomplished by a spring mounted for rotation in a groove on the surface of the form.

11. A method for dispensing discrete length reinforcement fibers comprising the steps of:

winding a continuous length of a reinforcement fiber around a base end of a form, the base end having a generally circular cross-section, at a winding speed which is at least about 10% greater than a winding speed around a form having an elongated cross-section with the same peripheral length as the base end, to form generally circular coils, the form having a longitudinal axis;

moving the coils axially from the base end of the form to an elongated portion of the form, the elongated portion having an elongated cross-section, the coils being moved on a generally smooth exterior surface of the form which changes gradually from the generally circular cross-section to the elongated cross-section, to gradually change the shape of the coils from the generally circular shape to the elongated shape;

cutting the elongated coils to form discrete length reinforcement fibers; and dispensing the discrete length reinforcement fibers generally parallel to each other.

12. The method of claim 11 in which the step of moving the coils from the base end of the form to the elongated portion of the form includes moving the coils on the form, with the form having a generally constant peripheral length between the base end and the elongated portion.

13. The method of claim 11 in which the step of winding the reinforcement fiber comprises winding the reinforcement fiber around a base end having a cross-section with a ratio of a longest diameter to a shortest diameter of not greater than about 1.8:1.

14. The method of claim 11 in which the step of cutting the elongated coils comprises cutting the coils to form two streams of discrete length reinforcement fibers, and in which the step of dispensing the discrete length reinforcement fibers comprises moving the two streams of discrete length reinforcement fibers axially from the cutter to a discharge end of the form, the two streams moving on smooth upper and lower surfaces of the form, and dispensing the discrete length reinforcement fibers from the discharge end, wherein the discharge end comprises an elongated edge so that the two streams are combined into a single stream as they are dispensed.

15. The method of claim 14 in which the upper and lower surfaces of the form are as wide at the discharge end as a length of the fibers.

16. A method for dispensing discrete length reinforcement fibers comprising the steps of:

winding a continuous length of a reinforcement fiber around a base end of a form, the base end having a generally circular cross-section, to form generally circular coils, the form having a longitudinal axis;

moving the coils axially from the base end of the form to an elongated portion of the form, the elongated portion having an elongated cross-section, the coils being moved on a generally smooth exterior surface of the form which changes gradually from the generally circular cross-section to the elongated cross-section, the form having a generally constant peripheral length between the base end and the elongated portion, to change the shape of the coils from the generally circular shape to an elongated shape;

cutting the elongated coils to form discrete length reinforcement fibers; and dispensing the discrete length reinforcement fibers generally parallel to each other.

17. The method of claim 16 in which the reinforcement fiber is wound without breaking around the base end having the generally circular cross-section, at a winding speed which is at least about 10% greater than a winding speed around a form having an elongated cross-section with the same peripheral length as the base end.

18. The method of claim 16 in which the step of winding the reinforcement fiber comprises winding the reinforcement fiber around a base end having a cross-section with a ratio of a longest diameter to a shortest diameter of not greater than about 1.8:1.

19. The method of claim 16 in which the step of cutting the elongated coils comprises cutting the coils to form two streams of discrete length reinforcement fibers, and in which the step of dispensing the discrete length reinforcement fibers comprises moving the two streams of discrete length reinforcement fibers axially from the cutter to a discharge end of the form, the two streams moving on smooth upper and lower surfaces of the form, and dispensing the discrete length reinforcement fibers from the discharge end, wherein the discharge end comprises an elongated edge so that the two streams are combined into a single stream as they are dispensed.

20. The method of claim 19 in which the upper and lower surfaces of the form are as wide at the discharge end as a length of the fibers.

* * * * *